United States Patent [19]

Jaklic, Jr. et al.

[11] 4,082,916

[45] Apr. 4, 1978

[54] ENCAPSULATED ELECTRICAL INDUCTIVE APPARATUS

[75] Inventors: Albin Jaklic, Jr., Sharon; Donald S. Stephens, Sharpsville, both of Pa.

[73] Assignee: Westinghouse Electric Corporation, Pittsburgh, Pa.

[21] Appl. No.: 751,782

[22] Filed: Dec. 16, 1976

[51] Int. Cl.[2] ..... H01F 27/22

[52] U.S. Cl. ..... 174/52 PE; 336/96

[58] Field of Search ..... 174/52 PE, 17 SF; 336/96; 264/272; 335/300

[56] References Cited

U.S. PATENT DOCUMENTS

| | | | |
|---|---|---|---|
| 1,947,085 | 2/1934 | Hill et al. | 174/52 PE |
| 2,941,905 | 6/1960 | Hofmann | 336/96 X |
| 3,161,843 | 12/1964 | Hodges et al. | 336/96 |

*Primary Examiner*—J. V. Truhe
*Assistant Examiner*—D. A. Tone
*Attorney, Agent, or Firm*—W. M. Hanlon, Jr.

[57] ABSTRACT

An electrical inductive apparatus encapsulated in a cured mixture of rounded gravel particles and resin-coated sand particles and covered with a layer of non-porous sealant material. A method of encapsulating an electrical inductive apparatus in which resin-coated sand particles are vibrated into a quantity of gravel particles which fill the space between the enclosure and the electrical inductive apparatus. A layer of sealant material is then added before the entire apparatus is subjected to an elevated temperature which cures the resin and forms an infusible, intersticial mass of gravel and sand particles around the electrical inductive apparatus.

16 Claims, 2 Drawing Figures

ENCAPSULATED ELECTRICAL INDUCTIVE APPARATUS

BACKGROUND OF THE INVENTION

1. Field of the Invention

This invention relates to electrical inductive apparatus and, more particularly, to encapsulated electrical inductive apparatus and methods for making the same.

2. Description of the Prior Art

Electrical inductive apparatus, such as transformers, reactors or the like, generate considerable quantities of heat during their operation which must be adequately dissipated if the device is to operate reliably. Many different methods are used to remove this heat, including circulating air or coolant fluid around the electrical inductive apparatus. One method used extensively with small transformers is to encapsulate the transformer in a case with a solid potting compound. This potting compound has higher thermal conductivity properties than air or oil and, as such, conducts considerable quantities of heat away from the transformer to the walls of the enclosure where it is carried off into the surrounding air. The usual method of encapsulating electrical inductive apparatus makes use of liquid synthetic resins which can be cured at a high temperature to a solid form. Although these types of materials are easy to work with and form a dense, solid mass, they are expensive and are also susceptible to shrinkage during the cure operation. This shrinkage, typically from 2 to 10% of the original volume, opens up voids or cracks between the enclosure and the transformer, which act as thermal barriers and impede the dissipation of heat away from the electrical inductive apparatus.

To lessen the detrimental effects of resin shrinkage, various inert, filler materials have been added along with the liquid resin to form the encapsulating compound. These inert materials, typically sand, alumina, mica or the like, are added in large amounts to reduce the quantity of resin used, and thereby lessen shrinkage. An example of this type of encapsulating compound is disclosed in U.S. Pat. No. 2,941,905, in the name of C. F. Hofmann and assigned to the assignee of the present application, wherein an inert filler material, such as sand, is poured into an enclosure which contains a transformer. A sufficient quantity of liquid resin is then added to completely impregnate the interstices between adjoining sand particles before the entire assembly is subjected to a high temperature for the length of time required to cure the resin. The resulting compound contains between 70 to 90% by weight of the inert filler material which gives it excellent resistance to crack formation and improved thermal conductivity.

Continued efforts have been made to increase the percentage of inert material in the potting compound to thereby improve its heat dissipation properties and further reduce shrinkage while at the same time providing a complete fill of all the interstices between adjoining particles. One such compound, as disclosed in U.S. Pat. No. 3,161,843 to Hodges, Antalis and Wood, uses resin-coated sand to form the encapsulating compound. In this type of encapsulating compound, a thermosetting resin compound is applied to each sand particle and partially cured such that each particle is covered with a thin film of dry resin. This resin coating, known as a "B" stage resin, is dry at ordinary room temperatures, but enters a fluid state when subjected to an elevated temperature and flows between adjoining sand particles to form cohesive bonds at the points of contact between adjoining particles as it hardens or cures. Since the resin coating constitutes only 5% of the weight of the coated sand particles, interstices result between the sand particles which are then filled with another insulating material. Although utilizing less resin than prior encapsulating compounds, this formulation uses additional material to completely fill the interstices between adjoining sand particles. This not only increases the cost of the encapsulating compound but adds additional manufacturing operations and could result in uneven heat dissipation if the insulating material does not completely fill all of the interstices.

A different method of improving the thermal conductivity of a potting compound involves the addition of a second filler material, such as gravel, in place of a portion of the sand. After the sand and gravel particles are poured into the case, according to this method, a sufficient quantity of liquid resin is then added to completely fill all of the interstices and wet all of the particle surfaces; which, when cured, binds the particles together into a solid mass. In order to obtain an even distribution of the sand and gravel particles throughout the encapsulating compound, it is necessary to mix the sand and gravel together before they are added to the enclosure since it has been heretofore impossible to get the sand particles to disperse evenly throughout the larger gravel particles when both materials are added separately to the enclosure. However, subsequent handling and pouring of the premixed sand and gravel mixture causes the larger gravel particles to separate from the sand particles, thereby creating concentrations of sand and gravel in the encapsulating compound, which causes voids and uneven heat dissipation. Furthermore, to insure complete wetting of the gravel and sand particles with the liquid resin, the components must be added to the enclosure in layers, that is, a layer of premixed sand and gravel followed by a small amount of liquid resin and then another layer of sand and gravel and continuing until the entire electrical inductive apparatus is covered with the encapsulating compound. Although less expensive than other types of encapsulating compounds, the separation of the gravel from the sand experienced with this method causes hot spots in the electrical inductive apparatus due to the uneven distribution of sand and gravel particles throughout the compound. Furthermore, the present method of manufacturing such an encapsulating compound is complex and time consuming.

Thus, it is still desirable, and it is an object of this invention, to provide an encapsulated electrical inductive apparatus wherein the encapsulating compound exhibits a high degree of thermal conductivity along with reduced shrinkage and which provides these characteristics at less cost than prior art encapsulating compounds.

It is also desirable and it is another object of this invention, to provide a new method for encapsulating electrical inductive apparatus with a compound containing certain large, inorganic particles and certain finely divided, resin-coated, inorganic particles; which method provides an even dispersion of both types of particles throughout the encapsulating compound and affords a simplified manufacturing operation.

SUMMARY OF THE INVENTION

Herein disclosed is an encapsulated electrical inductive apparatus when utilizes a novel encapsulating compound. This compound, which completely fills the space between the enclosure and the electrical inductive apparatus, consists of a cured mixture of rounded gravel particles and rounded, resin-coated sand particles wherein the average particle size of the gravel is significantly larger than the size of the sand particles. A moisture barrier is provided above the sand and gravel mixture which is comprised of a cured mixture of resin-coated sand and additional powdered resin. The resulting encapsulating compound exhibits a high degree of thermal conductivity with less shrinkage than encapsulating compounds used previously, and at the same time, has a lower material cost.

The high degree of thermal conductivity exhibited by this unique encapsulating compound is obtained by the novel combination of rounded gravel particles and rounded, resin-coated sand particles typically known as shell molding sand. The amount of resin used in shell molding sand is typically from about 2 to about 5% by weight of the coated sand particles which results in interstices being formed between adjoining sand and gravel particles when the compound is cured. These interstices would normally be expected to impede the dissipation of heat from electrical inductive apparatus to such an extent that the resulting temperature rise in the electrical inductive apparatus would necessitate either a de-rating of the device or the addition of extra iron and copper to the transformer. However, the addition of gravel in a sufficient quantity surprisingly increased the quantity of heat dissipated by this encapsulating compound; which, notwithstanding the interstices remaining in the compound, enables the transformer design to remain unchanged. Furthermore, these features are obtained at less cost than prior art encapsulating compounds due to the reduced amount of resin used and the replacement of a portion of the resin-coated sand with less expensive gravel.

Also disclosed in the present application is a unique method of encapsulating an electrical inductive apparatus in a compound consisting of rounded gravel particles and resin-coated sand particles which causes the sand and gravel particles to be evenly dispersed throughout the encapsulating compound. According to this method, the space between the electrical inductive apparatus and the enclosure is initially filled with the larger gravel particles. The requisite amount of resin-coated sand is then poured on top of the gravel before the entire enclosure is lightly vibrated to disperse the sand particles evenly throughout the gravel particles. A thin layer of sealant material, comprised of a mixture of resin-coated sand and additional powdered resin, is added on top of the sand and gravel mixture to form a moisture barrier for the encapsulating compound. The encapsulating compound is then subjected to a high temperature for a specific length of time to allow the resin to cure and thereby bond the sand and gravel particles into an infusible, intersticial mass.

As mentioned previously, the present method of mixing two materials of dissimilar size required a separate operation, generally involving centrifugal means, to attain an even dispersion of both materials. In addition, prior methods for encapsulating electrical inductive apparatus utilize vibrations to compact the filler material into a dense mass. These vibrations along with the handling and shipping of the pre-mixed mixture of filler materials causes a separation of the different filler materials from each other. The unique method disclosed in this invention overcomes these problems and, at the same time, eliminates manufacturing operation and reduces labor.

It would not be apparent to one skilled in the art that an even dispersion of filler materials of different sizes can be attained merely by pouring the smaller particles into the larger ones and applying vibrations of short duration and limited force. However, this method not only results in an even dispersion of both materials throughout the mixture, but the limited amount of vibration also does not cause any separation of the different materials from each other. Thus, an encapsulating compound is formed which has a previously difficult to obtain even dispersion of dissimilar filler materials.

BRIEF DESCRIPTION OF THE DRAWINGS

The various features, advantages and additional uses of this invention will become more apparent by referring to the following detailed description and the accompanying drawing, in which.

DESCRIPTION OF THE PREFERRED EMBODIMENT

Figure 1:
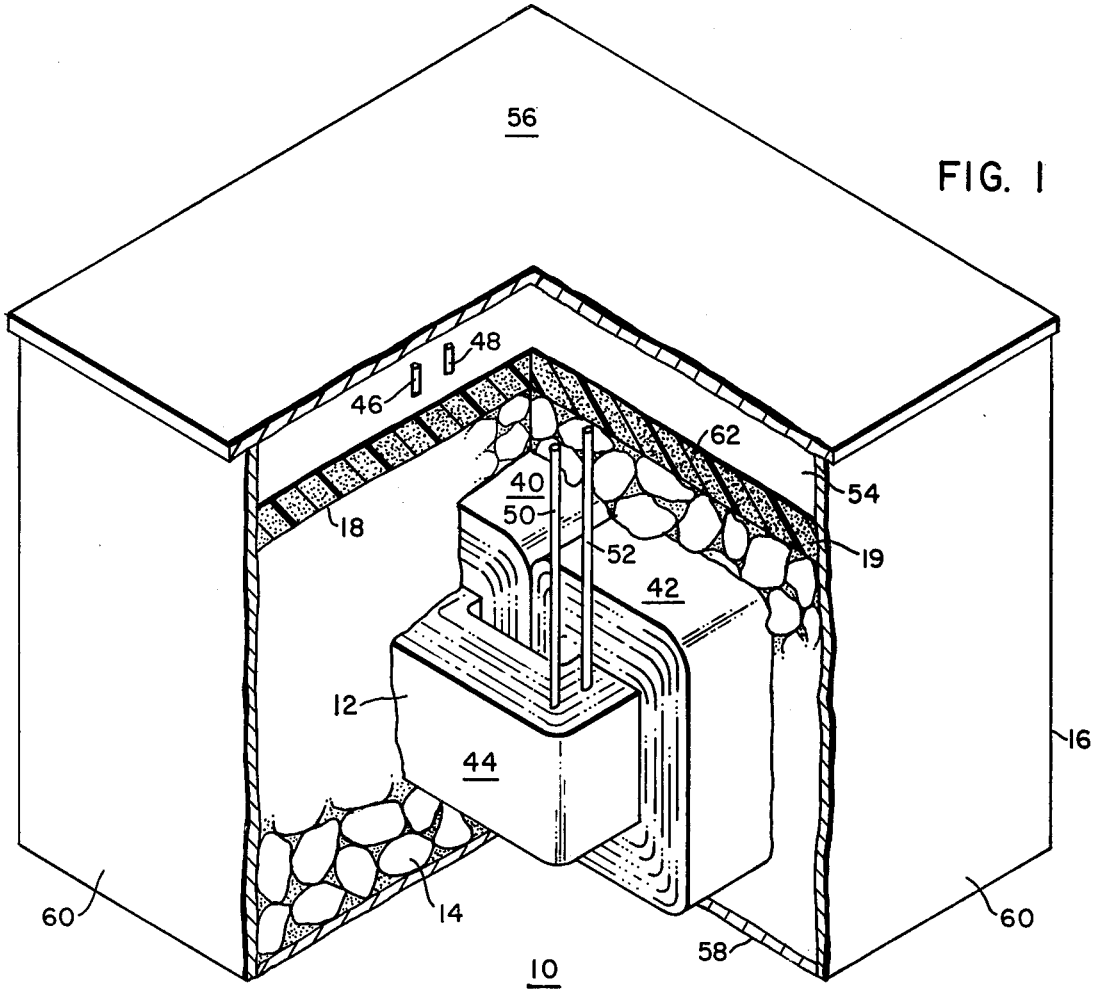
FIG. 1 is a perspective view, partially in section, of an electrical inductive apparatus embodying the present invention.

Throughout the following description, identical reference numbers refer to similar components in all figures of the drawing.

Referring now to the drawing, and to FIG. 1 in particular, there is shown an encapsulated electrical inductive apparatus 10 such as a transformer, reactor or the like, and hereafter referred to as a transformer, constructed according to the teachings of this invention. The transformer 10 is comprised of a magnetic core and coil assembly 12 wherein magnetic cores 40 and 42 have a phase winding 44, which represents both the primary and secondary windings of the transformer 10, disposed in inductive relation thereon. The magnetic core and coil assembly 12 is disposed in an enclosure or case 16 which is comprised of a top section 56, a bottom section 58 and side wall sections 60. The bottom portion 58 is secured to the side wall portions 60 by any suitable means, such as welding; while the top portion is attached to the side wall portions 60 in a manner that allows for subsequent attachment after the transformer 10 is encapsulated in the potting compound. The orientation of the transformer 10 shown in FIG. 1 is that used during manufacturing only; since in actual use, the transformer 10 is mounted in an inverted position with the bottom portion 58 of the case 16 being rotated 180° from that shown.

A thermal conductive encapsulating compound 14 fills the space between the side walls 60 of the case 16 and the magnetic core and coil assembly 12 to a level 18 above the top of the magnetic core and coil assembly 12. A thin layer, indicated generally by reference number 19, of non-porous sealant material 62 is situated above and in fused relation with the encapsulating compound 14 such that a space 54 is left between the top portion 56 of the case 16 and the layer 19 of sealant material 62.

Figure 2:
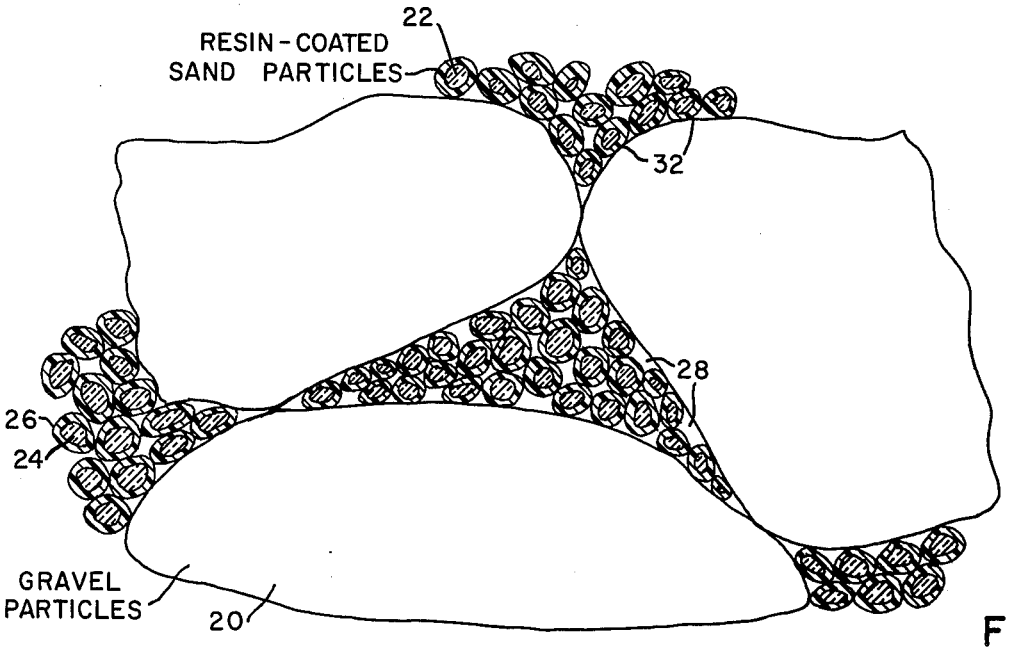
FIG. 2 is a magnified, sectional view of the encapsulating compound, showing the dispersion of the resin-coated sand and gravel particles in the enclosure before the final cure operation; with the size of the sand particles being exaggerated to show the resin coating on each particle.

The composition of the encapsulating compound 14 and the preferred method of assembly will now be presented in greater detail. Accordingly, the magnetic core and coil assembly 12 is initially positioned on the bottom portion 58 of the enclosure 16. A first, inert, inorganic, particulate, filler material 20 is then poured into the space between the core and coil assembly 12 and the side walls 60 of the enclosure 16 to a level 18 above the core and coil assembly 12. This first material 20 consists of loose rock fragments, such as gravel, as shown in FIG. 2. In the preferred embodiment, gravel with a generally spherical, oval or otherwise rounded surface, is utilized since the rounded particles compact into a denser mass than would angular particles. The rounded surfaces form a plurality of voids or gaps which allow the sand particles 22, to be added later, to flow easily between the contiguous gravel particles 20 and attain an even dispersion therein. Accordingly, natural deposited, river bed gravel which has a generally rounded surface is utilized in sizes varying from about ¼ inch to about 1 inch in diameter. Larger particle sizes make it difficult to obtain the desired even dispersion of sand 22 since the gaps become too large, thereby forming concentrations of sand particles 22 throughout the encapsulating compound 14.

To form the encapsulating compound 14, a second inert, inorganic, particulate, filler material 22 is poured into the enclosure 16 on top of the gravel 20. This second material 22 consists of finely-divided, rounded, inert, inorganic particles 24, each covered with a thin, dry resinous coating 26. Many types of resins, well known in the art, are suitable for coating such inert particles for the purpose of this invention and include phenolic, epoxy, polyester or polystyrene resinous compounds. No attempt will be made here to specify which particular resin is to be used since any of the above recited compounds exhibit the necessary features of being solid and dry (i.e., non-sticky) at ordinary room temperatures, but are capable of liquifying upon heating and forming a strong bond upon curing at points of contact between contiguous particles. Resins with these properties are known as "B" stage resins and have been used extensively as a bonding agent for sand to form shell molding sand. Furthermore, any compound which is dry at ordinary room temperatures but enters a liquid state at a temperature above the normal operating temperature of the electrical inductive apparatus, i.e., thermoplastic or thermosetting materials, may be adaptable for the purposes of this invention. Thus, a phenolic novolak type of resin is utilized in the preferred embodiment, and more particularly, one sold commercially by the Monsanto Company under the trade name of "Resinox 736".

The inert filler material to be coated with the resin compound consists of finely-divided, inert, inorganic particles such as silica, alumina or hydrated silicates. Examples of such materials, which may be used singly or in any combination of two or more, include sand, porcelain, slate, chalk, aluminum silicate, mica powder, glass and aluminum oxide. It is known that particles with a generally rounded exterior surface flow more easily than irregular or angular shaped particles. Furthermore, it has been established that a material consisting of particles of varying sizes within a certain particle size range, will compact into a denser mass than a material comprised of particles with a uniform size. Thus, sand is used as the second filler material in the preferred embodiment of this invention, and more specifically, round sand is utilized due to its easy availability in the desired range of particle sizes, generally accepted usage with resin coatings and excellent thermal conductivity properties. Accordingly, FIG. 2 shows inert filler particles 22, each comprised of a fine, rounded sand particle 24 covered with a thin resin coating 26. The shell molding sand used in the preferred embodiment of this invention had the following particle size distribution range.

TABLE 1

| Approximate Weight Percent | Sieve Size Mesh (U.S. Screen No.) |
|---|---|
| 2.4 | 30 |
| 18.6 | 40 |
| 31.2 | 50 |
| 28.2 | 70 |
| 14.2 | 100 |
| 5.2 | 140 |
| 1.2 | 200 |
| .2 | 270 |

In Table 1, approximate weight percent is interpreted as the weight percent of a filler material that would remain or be caught on each particular testing sieve if the filler material is sequentially sifted through sieves in decreasing particle size order.

The above particle size distribution is given for the purpose of illustrating a typical graduation of particle sizes and, as such, is not meant to exclude the use of other materials with different particle sizes. It is not within the scope of this invention to specify the exact filler material or the precise particle size distribution range, as any of the previously mentioned materials could be used in place of shell molding sand without any significant difference in pourability, compactability or thermal conductivity.

To reduce the amount of shrinkage of the encapsulating compound 14 during curing, the amount of resin 26, used to form the coating on each sand particle 24, is relatively small in proportion to the weight of each coated sand particle 22. Accordingly, the resin coating 26 constitutes from about 2 to about 5% of weight of each coated sand particle 22. The amount of resin utilized in shell molding sands is far less than that normally used in prior art encapsulating compounds utilizing liquid resins; where it is common practice to use resins in quantities varying from about 15 to about 30% by weight of the sand to obtain a complete wetting of all particle surfaces. The use of about 2 to about 5% resin by weight to coat each sand particle 24 intentionally leaves interstices 28 between the resin-coated sand particles 22 and the gravel particles 20 after the encapsulating compound 14 is cured. These interstices or voids 28 would normally be expected to impede the dissipation of heat away from the transformer 12 since the thermal conductivity of air is far less than that of sand ($k_{air}$ = 0.00066 to $k_{sand}$ = 0.0083, where $k$ is expressed in units of watts per inch per ° C). Since less heat would be dissipated, the resulting temperature rise in the transformer 10 would necessitate the addition of extra copper or iron to the transformer or a de-rating of the device. However, the use of a quantity of gravel 20 in place of a portion of the shell sand 22 surprisingly improved the heat dissipation capability of the encapsulating compound 14 to such an extent that the transformer 10 did not have to be redesigned or de-rated, notwithstanding the interstices 28 remaining in the encapsulating compound 14.

It is known that the thermal conductivity of an encapsulating compound comprised entirely of fine sand particles can be improved by substituting larger gravel particles for a portion of the sand due to the higher thermal conductivity of gravel ($k_{gravel} = 0.096$ to $k_{sand} = 0.0083$). Thus, the solid cross-section of a gravel particle will accordingly transfer more heat than an equivalent cross-section of sand particles. It has been found that the greatest portion of the heat transfer in an encapsulating compound occurs at the point of contact between the adjoining particles and in the area immediately surrounding the point of contact where the amount of separation between contiguous particles is miniscule. Since the area of contact and miniscule separation is greater for rounded particles than for angular particles, the unique combination of rounded gravel particles and rounded resin-coated sand particles affords an increase in heat dissipation capability. In tests, it was found that the thermal conductivity of a cured resin coated sand compound was about 0.021 (expressed in the same units as above). The thermal conductivity of a cured encapsulating compound comprised of about 65% gravel by weight and 35% resin coated sand was found to be 0.035. This surprising increase, notwithstanding the interstices remaining in the encapsulating compound, resulted in a decrease of about 8° C in the normal operating temperature of the transformer, thereby indicating improved heat dissipation by the encapsulating compound.

By adding the shell sand 22 to the gravel 20 according to the method disclosed above, the resulting encapsulating compound will be comprised of about 40 to about 60% by weight of the gravel particles 20. This not only improves the heat dissipation capability of the encapsulating compound 14, but further reduces its cost since a large portion of the shell sand 22 is replaced by less costly gravel 20 and also due to the fact that only 2 to 5% resin by weight is required to bind the sand 24 and gravel 20 particles together into an infusible mass. Furthermore, by coating only the fine sand particles 24 with a "B" stage resin, maximum bonding strength is achieved with minimum resin usage since the surface to volume ratio of the fine sand particles 24 is greater than that of the larger gravel particles 20.

After the resin-coated sand particles 22 are poured on top of the gravel 20, the entire enclosure 16 is subjected to a slight vibration to disperse the resin-coated sand particles 22 evenly throughout the gravel 20. The length of time that the vibration is applied and the amount of force used is critical and, indeed, a novel aspect of this invention. If the enclosure 16 is vibrated too long or too hard, the larger gravel particles 20 tend to separate from the sand particles 22, thereby resulting in an uneven distribution of particles which causes inefficient and uneven heat transfer. Likewise, if no vibration at all is applied, the resin-coated sand particles 22 will not disperse evenly throughout the gravel particles 20, again resulting in an uneven distribution. Any suitable means of vibrating the enclosure 16 may be used as long as it provides vibrations of short duration and relatively small force. Thus, merely dropping the enclosure 16 about 1 to 2 inches onto a solid surface will suffice to disperse the sand 22 evenly throughout the gravel particles 20.

The next step according to the preferred method consists of adding a thin layer of material 19 on top of the gravel and sand mixture 14 to form a sealant means or moisture barrier 62 for the encapsulating compound 14. Although any suitable material with a non-porous structure can be used to form the moisture barrier 62, a mixture of resin-coated sand 22 and additional powdered resin, identical to the resin coating 26 on each sand particle 24, is utilized in the preferred embodiment since it has the same cure temperature as the encapsulating compound 14. The resin-coated sand 22 and the powdered resin are premixed and added directly on top of the sand and gravel mixture 14 in the enclosure 16 before the final cure operation. According to the preferred embodiment, the moisture barrier 62 consists of about 10% by weight of powdered, phenolic resin and about 90% resin-coated sand 22. This has the effect of increasing the amount of resin in the moisture barrier 62 to about 15% by weight such that the interstices between adjoining sand particles are completely filled by the resin after curing, thereby resulting in a non-porous material that adds mechanical strength and prohibits moisture from penetrating the encapsulating compound 14. Other mixtures could easily be used to form the moisture barrier 62 and could include the use of room set resins that cure to a hardened form at ordinary room temperatures or compounds not utilizing an inert filler material such as sand. According to the preferred embodiment of this invention, the moisture barrier 62 is about ¼ inch thick which is sufficient to completely cover the uneven top of the sand and gravel mixture 14 and provide adequate mechanical strength therefor. When larger transformers are encapsulated according to the method taught by this invention, it is desirable to increase the thickness of the moisture barrier 62. Thus, a one inch thick moisture barrier would be used when a 30 KVA transformer is encapsulated, in the presently disclosed gravel and sand mixture.

Once the sealent material 62 is added, the potted transformer 10 is placed in a suitable heating device to bring it to the curing temperature of the specific resin used for the period of time necessary to cure the resin into a solid form. For the particular phenolic novolak resin used in the preferred embodiment of this invention, this amounted to a curing time of about three hours at about 135° C (275° F). During this time, the resin coating 26 on each sand particle 24 initially enters a fluid state and flows between adjoining sand and gravel particles 20 and 22, thereby wetting the surfaces of contiguous particles at their points of contact, shown generally by reference number 32, and forming cohesive bonds only at these points as it hardens or cures; whereby interstices 28 are formed throughout the encapsulating compound 14 between the non-contacting portions of the contiguous sand and gravel particles 22 and 20.

It will be apparent to one skilled in the art that there has been disclosed an encapsulated electrical inductive apparatus utilizing a novel, encapsulating compound that exhibits a high degree of thermal conductivity and less shrinkage than encapsulating compounds known in the prior art and which provides these characteristics at less cost than previously used encapsulating compounds. The unique composition of the encapsulating compound, which is comprised of about 40 to about 60% by weight of rounded gravel particles, gives an unexpected high degree of thermal conductivity which dissipates considerable quantities of heat away from the electrical inductive apparatus. The excellent thermal conductivity properties of gravel permits the amount of shell sand to be reduced, thereby decreasing both shrinkage and material costs while, at the same time, improving the overall thermal conductivity over prior art encapsulating compounds, notwithstanding the interstices remaining in the presently disclosed, cured encapsulating compound.

Also disclosed is a unique method of encapsulating an electrical inductive apparatus which easily provides a previously difficult to obtain even dispersion of sand and gravel particles throughout the encapsulating compound. By utilizing particles of a specific size range and rounded shape and applying a minimum amount of vibration to the enclosure while mixing the sand and gravel together, the method disclosed in the present invention causes the sand to evenly disperse amongst the gravel particles, thereby insuring maximum strength and heat dissipation in the encapsulating compound while saving considerable manufacturing time and expense.

What is claimed:

1. An encapsulated electrical inductive apparatus comprising:

an electrical inductive apparatus;

a case surrounding said electrical inductive apparatus;

an infusible, thermal conductive mixture filling the space between said case and said electrical inductive apparatus;

said thermal conductive mixture comprised of at least first and second inert, inorganic, particulate materials cohesively joined by a binder material; the average size of said particles of said first material being substantially larger than the average size of said particles of said second material;

said binder material coating said particles of said second material only, so as to cohesively join said particles of said second material to contiguous particles of said first and second materials only at their points of contact such that interstices are formed between the non-contacting portions of said particles of said first and second materials.

2. The encapsulated electrical inductive apparatus of claim 1 wherein the inert, inorganic particles of the first material are rounded gravel particles having an average size of between about ¼ inch in diameter to about 1 inch in diameter.

3. The encapsulated electrical inductive apparatus of claim 1 wherein the inert, inorganic particles of the second material are rounded sand particles of non-uniform size.

4. The encapsulated electrical inductive apparatus of claim 1 wherein the binder material is a cured resin.

5. The encapsulated electrical inductive apparatus of claim 4 wherein the binder material is a cured thermosetting resin which forms a coating around each particle of said second material of such thickness that said resin constitutes from about 2 to about 5% of the weight of each coated particle of said second material.

6. The encapsulated electrical inductive apparatus of claim 1 wherein the thermal conductive mixture is comprised of between about 40 to about 60% by weight of said first material.

7. The encapsulated electrical inductive apparatus of claim 1 wherein sealant means is provided for the thermal conductive mixture.

8. The encapsulated electrical inductive apparatus of claim 7 wherein the sealant means consists of finely-divided, inert, inorganic particles cohesively joined together by a cured resin.

9. The encapsulated electrical inductive apparatus of claim 8 wherein the cured resin material in the sealant means constitutes from about 10 to about 15% by weight of the sealant means whereby all of the interstices between adjoining particles in said sealant means are filled with said resin.

10. An encapsulated electrical inductive apparatus comprising:

an electrical inductive apparatus;

a case surrounding said electrical inductive apparatus;

an infusible, thermal conductive mixture filling the space between said case and said electrical inductive apparatus;

said thermal conductive mixture comprised of at least first and second inert, inorganic, particulate materials cohesively joined by a binder material, wherein said mixture is composed of between about 40 to about 60% of said first material by weight;

said first material being rounded gravel particles having an average particle size of between about ¼ inch to about 1 inch in diameter;

said second material being finely-divided, rounded sand particles of non-uniform size;

said binder material consisting of a cured thermosetting resin forming a coating around each sand particle of such thickness that said resin constitutes between about 2 to about 5% of the weight of each coated sand particle, said resin coating being sufficient to cohesively join said sand particles to contiguous sand and gravel particles only at their points of contact thereby leaving interstices between the non-touching portions of contiguous sand and gravel particles;

a non-porous sealant mixture forming a moisture barrier for said thermal conductive mixture; said sealant mixture consisting of finely-divided, inert, inogranic particles cohesively joined together by a cured resin which constitutes from about 10 to about 15% by weight of said sealant mixture such that all interstices between contiguous particles are completely filled by said resin.

11. The method of encapsulating an electrical inductive apparatus comprising the steps of:

positioning said electrical inductive apparatus in a case;

filling the space between said case and said electrical inductive apparatus with a first material, consisting of uncoated, inert, inorganic particles, to a level above the top of said electrical inductive apparatus;

pouring a second material consisting of finely-divided, inert, inorganic particles, each coated with a "B" stage thermosetting resin, onto said first material in said case;

vibrating said case until said second material is evenly dispersed throughout said first material;

solidifying said resin to form an infusible, intersticial mass of said first and second materials.

12. The method of encapsulating an electrical inductive apparatus of claim 11 wherein the steps are performed in the recited order.

13. The method of encapsulating an electrical inductive apparatus of claim 12 including the additional step of pouring a sealant mixture of powdered resin and finely-divided, inert, inorganic particles, each coated with a "B" stage resin, onto the mixture of the first and second materials after the step of applying vibrations but prior to the step of solidifying the resin.

14. The method of encapsulating an electrical inductive apparatus of claim 11 including the step of selecting a first material such that all of the inert, inorganic particles have a substantially rounded exterior surface.

15. The method of encapsulating an electrical inductive apparatus of claim 11 including the step of selecting the second material such that all of the finely-divided, inert, inorganic particles have a substantially rounded exterior surface.

16. The method of encapsulating an electrical inductive apparatus of claim 11 including the step of selecting the first and second materials such that all of the inert, inorganic particles of said first and second materials have a substantially rounded exterior surface.

* * * * *